US005404694A

United States Patent [19]

Boriani et al.

[11] Patent Number: 5,404,694

[45] Date of Patent: Apr. 11, 1995

[54] METHOD OF PRODUCING CARTONS OF CIGARETTES

[75] Inventors: Silvano Boriani; Antonio Gamberini, both of Bologna, Italy

[73] Assignee: G.D Societa' Per Azioni, Bologna, Italy

[21] Appl. No.: 25,192

[22] Filed: Mar. 2, 1993

[30] Foreign Application Priority Data

Mar. 3, 1992 [IT] Italy ..... BO92A0071

[51] Int. Cl.[6] ..... B65B 49/08; B65B 11/02

[52] U.S. Cl. ..... 53/466; 53/491; 53/218; 53/228; 53/377.3

[58] Field of Search ..... 53/466, 491, 218, 228, 53/230, 231, 232, 376.4, 376.8, 377.3, 229

[56] References Cited

U.S. PATENT DOCUMENTS

| | | | |
|---|---|---|---|
| 3,006,119 | 10/1961 | Fingerhut | 53/230 X |
| 3,462,915 | 8/1969 | Anderson | 53/230 |
| 3,685,253 | 8/1972 | Herrell et al. | 53/228 |
| 4,313,290 | 2/1982 | Furuya et al. | 53/232 X |
| 4,480,421 | 11/1984 | Rece | 53/376.5 X |
| 4,612,752 | 9/1986 | Deal | 53/377.3 |
| 5,056,294 | 10/1991 | Focke | 53/230 X |
| 5,133,173 | 7/1992 | Draghetti et al. | 53/466 |

FOREIGN PATENT DOCUMENTS

| | | |
|---|---|---|
| 0161542 | 11/1985 | European Pat. Off. . |
| 527900 | 10/1940 | United Kingdom . |

*Primary Examiner*—John Sipos
*Assistant Examiner*—Daniel Moon
*Attorney, Agent, or Firm*—Klauber & Jackson

[57] ABSTRACT

A method of producing cartons of packets of cigarettes, whereby a blank, folded in a U about a respective group of packets so as to leave three exposed surfaces from each of which at least two tabs of the blank project outwards, is finish-folded, over at least one of the exposed surfaces, by a respective single folding head having a folding device for each tab, and which provides for folding the tabs in the course of one linear movement in a direction parallel to the tabs for folding and to the respective exposed surface, and with the blank maintained stationary, together with the respective group of packets, in a folding station.

7 Claims, 2 Drawing Sheets

METHOD OF PRODUCING CARTONS OF CIGARETTES

BACKGROUND OF THE INVENTION

The present invention relates to a method of producing cartons of cigarettes.

Cartons of cigarettes are known to be produced using flat, precut blanks, each of which is folded along yield lines to define a box housing a respective group of packets of cigarettes constituting the content of the carton.

According to one known method, each blank is folded in a U about a respective group of packets, so as to cover three of the surfaces of the group and leave a further three surfaces exposed, from each of which exposed surfaces the blank presents at least two outwardly-projecting tabs, which are subsequently folded to cover the respective exposed surface.

For folding the tabs projecting from each exposed surface, Italian Patent Application N. 3422A/90 utilizes, for at least one of the surfaces, a folding head past which the U-folded blank and the respective group of packets are fed so as to gradually fold part of the tabs squarely. Subsequently, the folding head is moved in a direction substantially perpendicular to the traveling direction of the blanks, so as to complete square-folding of the respective tabs.

Though employed successfully on cartoning machines, the above known method presents several drawbacks, mainly due to both the blank with the respective group of packets and the folding head necessarily being moved during the tab folding process, thus resulting in obvious mechanical complications and the possibility of the blank being moved incorrectly in relation to the stationary folding head.

SUMMARY OF THE INVENTION

It is an object of the present invention to provide a method of producing cartons of cigarettes, designed to overcome the aforementioned drawbacks.

According to the present invention, there is provided a method of producing cartons of cigarettes, said method comprising a stage wherein a blank is folded in a U about a respective group of packets of cigarettes, in such a manner that the blank leaves three surfaces of the group exposed, and presents at least two tabs projecting outwards of and substantially perpendicular to each said exposed surface; characterized by the fact that it comprises a further stage wherein, for at least one of said surfaces, said blank is finish-folded about the respective said group by maintaining the blank and respective group of packets stationary at a folding station, and by squarely folding all the tabs projecting from said surface using a single folding head to which is imparted a single linear movement in a direction parallel to the tabs for folding and to the respective exposed surface.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
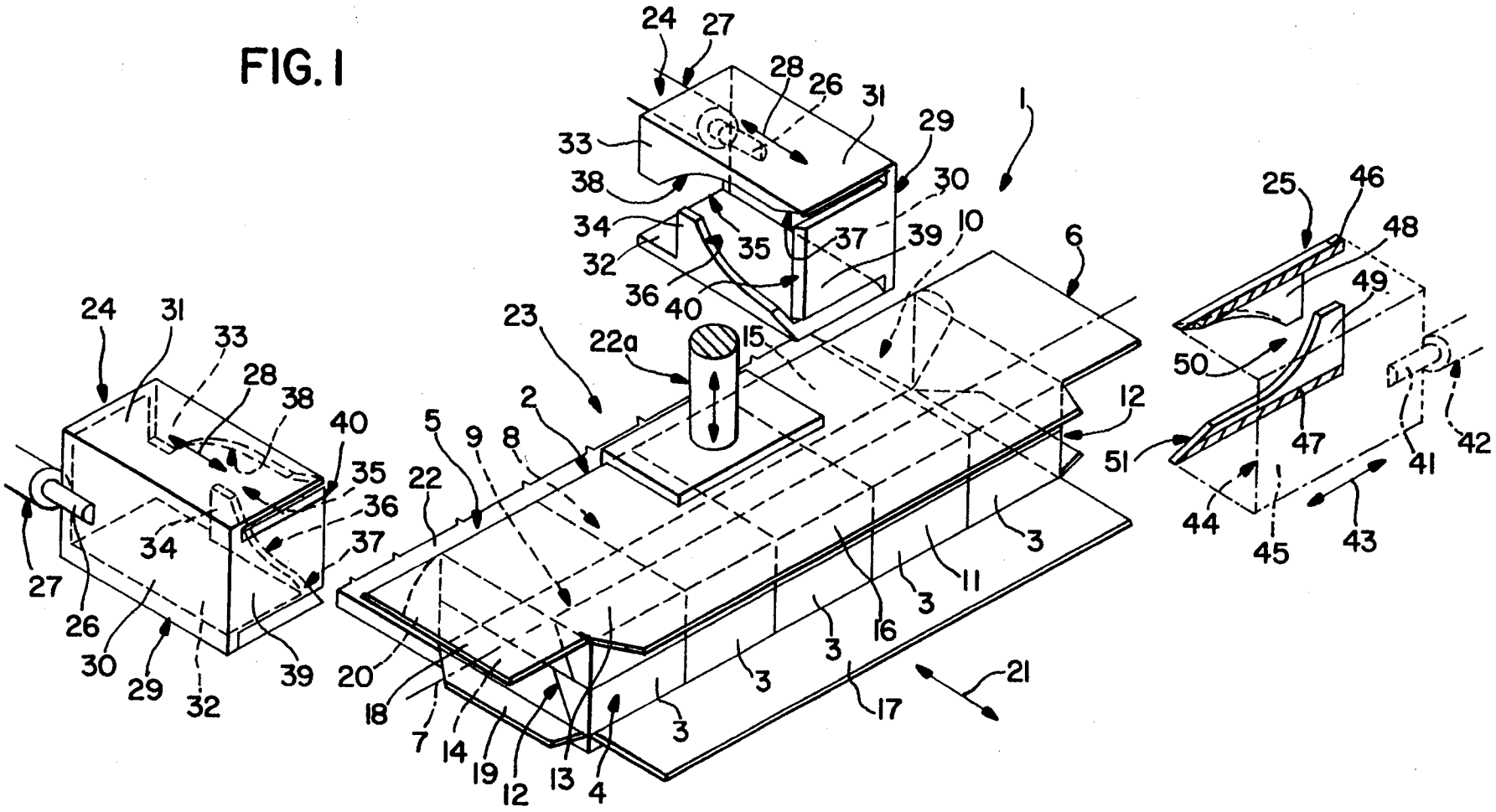
FIG. 1 shows a view in perspective, with parts removed for clarity, of a cartoning machine implementing the method according to the present invention.

Number 1 in FIG. 1 indicates a cartoning machine for producing cartons of cigarettes 2, each comprising a number of packets of cigarettes 3 arranged side by side in layers so as to form a group 4 in the form of a parallelepipedon, and housed inside a single box 5 defined by a known blank 6 of precut sheet material.

Group 4 presents a longitudinal axis 7, and is defined by two large longitudinal lateral surfaces 8 and 9, two small longitudinal lateral surfaces 10 and 11, and two end surfaces 12.

Machine 1 comprises a known loading station (not shown) where each group 4 is assigned a respective blank 6, which is folded in a U about and contacting group 4 so that surfaces 8 and 9 are covered by respective lateral panels 13 and 14; surface 10 is covered by intermediate panel 15; two longitudinal tabs 16 and 17 respectively integral with panels 13 and 14 project outwards of surface 11; and two tabs 18 and 19 respectively integral with respective longitudinal ends of panels 13 and 14, and a tab 20 integral with a respective end of panel 15, project from each end surface 12.

As shown in FIG. 1, tab 17 is substantially the same size as surface 11 and substantially twice as wide as tab 16, while each tab 18 is substantially the same size as respective surface 12 and substantially twice as wide as respective tab 19.

Once blank 6 is folded in a U about group 4 in known manner as described above, assembly 4, 6 is fed by known pushers (not shown) in direction 21 perpendicular to panel 15 and longitudinal axis 7, and, by means of a clamping device 22*a*, is clamped in a fixed position on a plate 22 and inside a folding station 23 forming part of machine 1. For each surface 12 of group 4 clamped in position in station 23, station 23 comprises a folding head 24 for folding respective tabs 18, 19 and 20 of blank 6 on to surface 12, with tab 18 on top of tabs 19 and 20. Folding station 23 also comprises a third folding head 25 for surface 11 of group 4 clamped in position in station 23, and which provides for folding respective tabs 16 and 17 of blank 6 on to surface 11, with tab 17 on top of tab 16.

Each head 24 is connected to the output rod 26 of a respective known linear actuator indicated as a whole by 27, and which provides for imparting to respective head 24 a linear work movement in direction 28 parallel to direction 21 and to respective surface 12, and a linear return movement between two limit positions (only one of which is shown in FIG. 1) on either side of surface 12.

As shown in FIG. 1, each head 24 comprises a U-shaped bracket 29 having its concavity facing respective surface 12 of group 4 clamped inside station 23, and defined by a central wall 30 parallel to respective surface 12 and from the top and bottom ends of which project two rectangular walls 31 and 32 substantially parallel to plate 22.

Figure 2:
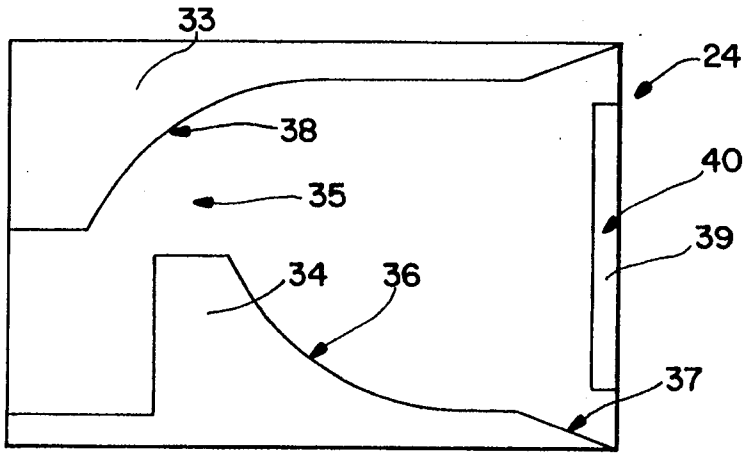
FIG. 2 shows a side view of a first detail in FIG. 1.

As shown in FIG. 1 and, in particular, FIG. 2, each head 24 also comprises a first and second helical folding device 33 and 34 substantially coplanar with respective surface 12 of group 4 in station 23, and extending towards each other so as to define a channel 35 of variable width engaged by respective tabs 18 and 19 during the work stroke of respective head 24. More specifically, folding device 34 is defined by a plate substantially in the form of a rectangular trapezium, having its longer edge connected to a free end portion of wall 32, and extending towards wall 31, parallel to wall 30. Folding device 34 is partially defined at the free end by a curved edge 36 having its concavity facing wall 31, and sloping towards inlet 37 of channel 35, which, as of inlet 37, tapers from a width greater than to a width smaller than the distance between surfaces 8 and 9 of group 4.

Similarly, folding device 33 is defined by a plate substantially in the form of a rectangular trapezium, having its longer edge connected integral with a free end portion of wall 31, and extending towards wall 32, parallel to wall 30. On the side facing folding device 34, folding device 33 is defined, at least partially, by a curved edge 38 having its concavity facing wall 32, and sloping towards inlet 37 of channel 35.

As shown in FIGS. 1 and 2, each head 24 also comprises a further folding device 39 perpendicular to direction 28 and projecting from the lateral edge of wall 30 facing inlet 37 of channel 35 and located frontwards during the work movement of head 24 in direction 28. Folding device 39 is defined at the free end by a straight edge 40 substantially coplanar with surface 12 of group 4 in station 23.

Figure 3:
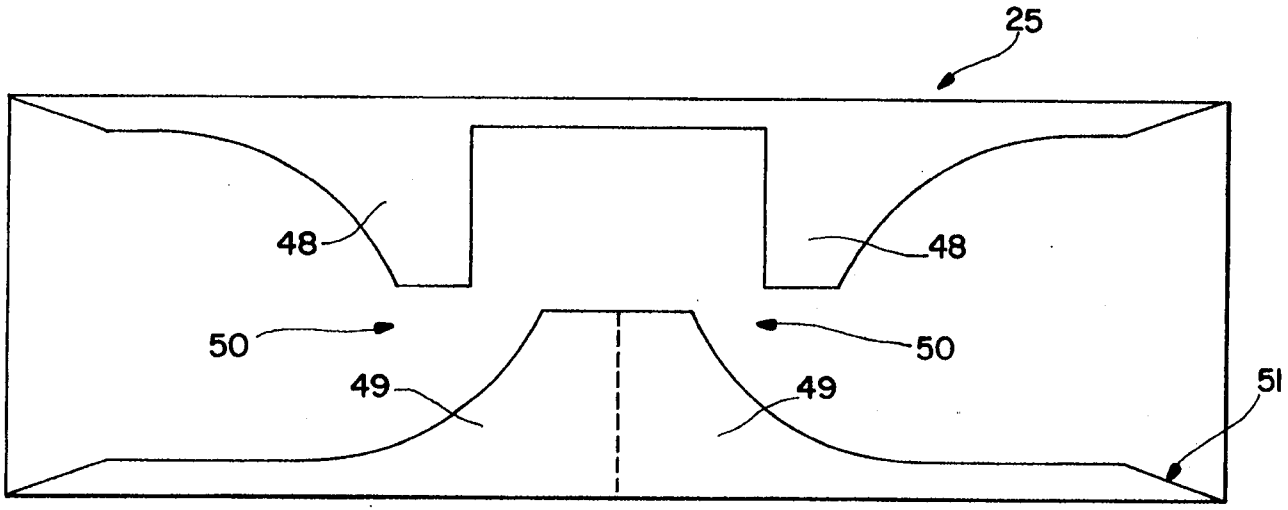
FIG. 3 shows a side view of a second detail in FIG. 1.

With reference to FIGS. 1 and 3, head 25 is connected to the output rod 41 of a known linear actuator indicated as a whole by 42, and which provides for imparting to head 25 a reciprocating linear movement in direction 43 perpendicular to direction 21 and parallel to surface 11, and between two limit positions (only one of which is shown in FIG. 1) on either side of surface 11 in relation to direction 43.

Head 25 (FIG. 1) comprises a U-shaped bracket 44 having its concavity facing surface 11 of group 4 clamped on to plate 22, and in turn comprising a central wall 45 parallel to surface 11 and from the top and bottom ends of which project rectangular walls 46 and 47 substantially parallel to plate 22. As shown also in FIG.3, head 25 also comprises a pair of first helical folding devices 48, and a pair of second helical folding devices 49. First folding devices 48 are geometrically similar to devices 34, each present the longer side connected integral with wall 46, and are coplanar with each other and substantially with surface 11 of group 4 clamped in station 23. Second folding devices 49 are geometrically similar to devices 33, each present the longer side connected integral with wall 47, and are also coplanar with each other and substantially with surface 11 of group 4 clamped in station 23. Each folding device 49 is located facing a respective device 48, so as to define the opposite edges of a respective channel 50 of variable width and geometrically similar to channels 35. More specifically, channels 50 are positioned specularly in relation to each other and along the center line of head 25 in direction 43, and present respective inlets 51 at either end of head 25 in relation to direction 43. Channels 50 communicate with each other and, like channels 35, taper as of respective inlet 51 from a width greater than to a width smaller than the distance between surfaces 8 and 9 of group 4.

In actual use, when assembly 4, 6 is fed into station 23 and clamped on to plate 22 by clamping device **22*a*, with surfaces 12 parallel to directions 28 and substantially coplanar with respective folding devices 33 and 34, and with surface 11 parallel to direction 43 and substantially coplanar with folding devices 48 and 49, head 25 is set to one of its two limit positions, clear of the path of assembly 4, 6 towards station 23, e.g. to the right of assembly 4, 6, as shown in FIG. 1, while each of heads 24 is set to the idle position shown in FIG. 1, downstream from station 23 in relation to direction 21**.

At this point, actuators 27 are operated so as to move respective heads 24 in direction 28 and from said idle position into a limit position upstream from station 23 in relation to direction 21. As each head 24 is so moved, folding device 39 engages respective tab 20 and folds it squarely on to respective surface 12; folding device 34 then engages respective tab 19 and folds it squarely in known manner on to respective surface 12; and folding device 33 then engages respective tab 18 and folds it squarely in known manner towards respective surface 12 and on to tabs 19 and 20.

Heads 24 are then restored to the idle position so as not to interfere with head 25, which, upon heads 24 clearing station 23, is moved by actuator 42 in direction 43 and from the FIG. 1 limit position to a further limit position (not shown) to the left of assembly 4, 6 as shown in FIG. 1. As head 25 is so moved, the leading folding devices 48 and 49 provide in known manner for squarely folding tab 16 on to surface 11, and tab 17 on to tab 16, thus completing box 5.

Head 25 is arrested in this position, and is moved back to the FIG. 1 limit position during the next folding cycle.

According to a variation not shown, at least one of heads 24 and 25 may obviously be replaced in known manner by a number of known movable folding devices, each designed to squarely fold a respective tab.

We claim:

1. A method for producing cartons of cigarettes (2), said method comprising the steps of:

folding a blank (6) about a respective group (4) of packets of cigarettes (3), wherein said blank (6) covers three surfaces (8, 9, 10) of said respective group (4), wherein said blank (6) leaves three surfaces (11, 12) of said respective group (4) exposed, and wherein said blank (6) presents at least two tabs (16, 17, 18, 19) projecting outwards of and substantially perpendicular to each said exposed surface (11, 12);

maintaining said blank (6) and said respective group (4) of packets of cigarettes (3) in a stationary position at a folding station (23); and folding said at least two tabs (16, 17, 18, 19) projecting outwards of and substantially perpendicular to each said exposed surface (11, 12) with one of three dedicated folding heads (24, 25), wherein each said dedicated folding head (24, 25) is dedicated to a respective said exposed surface (11, 12), and wherein each said dedicated folding head (24, 25) moves along a linear path (28, 43) in a direction that is parallel to a respective said at least two tabs (16, 17, 18, 19) and to a respective said exposed surface (11, 12).

2. The method as defined in claim 1, wherein said step of folding said at least two tabs (16, 17, 18, 19) of each said exposed surface (11, 12) with one of three dedicated folding heads (24, 25) comprises gradually engaging said at least two tabs (16, 17, 18, 19) inside a folding channel (35, 50) defined by two helical folding devices (33, 34, 48, 49) formed on each said dedicated folding head (24, 25), wherein said two helical folding devices (33, 34, 48, 49) are arranged facing each other and substantially coplanar with a respective said exposed surface (11, 12).

3. The method as defined in claim 2, wherein said step of folding said at least two tabs (16, 17, 18, 19) of each said exposed surface (11, 12) with one of three dedicated folding heads (24, 25) further comprises having each said helical folding device (33, 34, 48, 49) cooperate with one of a respective said at least two tabs (16, 17, 18, 19) so as to fold it squarely onto a respective said exposed surface (11, 12) while a respective said dedicated folding head (24, 25) is moving along its linear path, wherein all of a respective said at least two tabs (16, 17, 18, 19) are engaged successively by the helical folding devices (33, 34, 48, 49) formed on a respective said dedicated folding head (24, 25) so as to be squarely folded one on top of the other onto a respective said exposed surface (11, 12).

4. The method as defined in claim 3, wherein said step of folding said at least two tabs (16, 17, 18, 19) of each said exposed surface (11, 12) with one of three dedicated folding heads (24, 25) further comprises moving at least one of said dedicated folding heads (24) forward and backward between two rest positions on either side of said folding station (23) along a linear path (28) in a direction that is parallel to a respective said exposed surface (12) that is a transverse end surface of said group (4), wherein a respective said at least two tabs (18, 19) are squarely folded during said forward movement.

5. The method as defined in claim 4, wherein said step of folding said at least two tabs (16, 17, 18, 19) of each said exposed surface (11, 12) with one of three dedicated folding heads (24, 25) further comprises folding at least one further tab (20) of said blank (6) prior to folding a respective said at least two tabs (18, 19), wherein said at least one further tab (20) projects outwards of a respective said exposed surface (12) and extends between said respective at least two tabs (18, 19), and wherein said at least one further tab (20) is squarely folded onto a respective exposed surface (12) by a further folding device (39) formed on a respective said folding head (24) and located at the inlet (37) of said folding channel (35).

6. The method as defined in claim 3, wherein said step of folding said at least two tabs (16, 17, 18, 19) of each said exposed surface (11, 12) with one of three dedicated folding heads (24, 25) further comprises moving one of said dedicated folding heads (25) a first way between two rest positions on either side of said folding station (23) along a linear path (43) in a direction that is parallel to a respective said exposed surface (12) that is a longitudinal lateral surface of said group (4), and moving said dedicated folding head (25) a second way, opposite the first way, between said two rest positions during a subsequent folding cycle.

7. The method as defined in claim 6, wherein said step of folding said at least two tabs (16, 17, 18, 19) of each said exposed surface (11, 12) with one of three dedicated folding heads (24, 25) further comprises gradually engaging a respective said at least two tabs (16, 17) inside said folding channel (50), wherein said folding channel (50) presents two aligned, specular channel portions (50), and wherein said respective said at least two tabs (16, 17) are squarely folded while said one of said dedicated folding heads (25) is moved either said first way or said second way.

* * * * *